United States Patent [19]

Martin et al.

[11] 4,320,789

[45] Mar. 23, 1982

[54] COLLAPSIBLE SOLUTION CONTAINER

[75] Inventors: Jerry D. Martin, Kenosha, Wis.; Gary A. Ward, Round Lake, Ill.; David A. Winchell, Twin Lakes, Wis.

[73] Assignee: Baxter Travenol Laboratories, Inc., Deerfield, Ill.

[21] Appl. No.: 151,355

[22] Filed: May 19, 1980

Related U.S. Application Data

[63] Continuation of Ser. No. 28,152, Apr. 9, 1979, abandoned.

[51] Int. Cl.[3] ..... B65D 1/02

[52] U.S. Cl. ..... 150/0.5; 128/214 D; 128/DIG. 24; 222/107

[58] Field of Search ..... 150/0.5; 128/214 D, 128/214 F, DIG. 24; 222/107

[56] References Cited

U.S. PATENT DOCUMENTS

| | | | |
|---|---|---|---|
| 3,081,002 | 3/1963 | Tauschwiski | 222/107 |
| 3,110,308 | 11/1963 | Bellamy | 128/214 D |
| 4,010,783 | 3/1977 | Ralston . | |
| 4,049,033 | 9/1977 | Ralston . | |
| 4,076,063 | 2/1978 | Cammarata | 150/0.5 |
| 4,088,166 | 5/1978 | Miller | 150/0.5 |
| 4,090,541 | 5/1978 | Cammarata | 150/0.5 |

FOREIGN PATENT DOCUMENTS

| | | | |
|---|---|---|---|
| 1356549 | 2/1964 | France | 222/107 |

*Primary Examiner*—Herbert F. Ross

*Attorney, Agent, or Firm*—Paul C. Flattery; John P. Kirby, Jr.; Garrettson Ellis

[57] ABSTRACT

A molded collapsible solution container which defines a body portion having an integral neck portion and a relatively stiff shoulder portion and sealed at the opposite end, with gusset portions defined in the body portion adjacent the shoulder portion at opposite sides thereof. The shoulder portion extends outwardly from the neck portion and also extends axially rearwardly away from the neck portion in tapered manner. Sections of the shoulder portion adjacent the gusset portions normally extend in a plane perpendicular to the longitudinal axis of the container, being connected to the remainder of the shoulder portion by an angular crease line and being flexible to permit axially forward bending of the sections about the crease line as the container collapses by draining. Also, the tail seal at the opposite end may define a convex, arcuate seal for improved strength.

5 Claims, 6 Drawing Figures

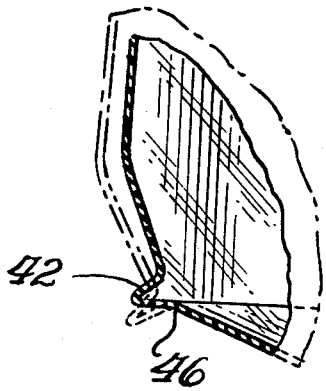

COLLAPSIBLE SOLUTION CONTAINER

CROSS-REFERENCE TO RELATED APPLICATION

This application is a continuation of U.S. application Ser. No. 28,152, filed Apr. 9, 1979, now abandoned.

BACKGROUND OF THE INVENTION

In U.S. Pat. Nos. 4,049,033, 4,010,783, 4,076,063, and 4,088,166 plus U.S. application Ser. No. 744,230, filed Nov. 23, 1976 now U.S. Pat. No. 4,090,541, among others, molded collapsible solution containers are shown which may be made out of a relatively stiff plastic, such as a copolymer which is predominantly polypropylene. Despite the relative stiffness of the bag material compared with, for example, a typical medical grade formulation of polyvinyl chloride, the bags are readily collapsible under a liquid suction pressure head on the order of three feet, so that the container may be effectively used for storing and dispensing parenteral solutions, blood or blood components, or the like.

The improved collapsibility of the bags of the above described patents and applications results from the as-molded tapered shape of the container, plus the use of opposed gussets near the shoulder portion defining beads of folding weakness, as well as other lateral beads of folding weakness about the shoulder, as described in the above reference.

In accordance with this invention, further improvements are provided to the containers described above, which result in an even greater reduction in the internal volume of the containers in their collapsed configurations, as well as improved tail seals over that which has been previously available for thin-walled, collapsible containers.

DESCRIPTION OF THE INVENTION

In accordance with this invention, a molded, collapsible solution container is provided, which container defines a body portion having an integral neck portion and a relatively stiff shoulder portion at one end thereof, and is sealed at its end opposite the one end. A pair of gusset portions is defined in the body portion adjacent the shoulder portion at opposite sides thereof, with the shoulder portion extending outwardly from the neck portion and simultaneously extending axially rearwardly away from the neck portion, in a manner described in the previously cited patents and applications.

In accordance with this invention, sections of the shoulder portions which are adjacent the gusset portions, in their normal, as-molded configuration, extend in a plane perpendicular to the longitudinal axis of the container, being connected to the remainder of the shoulder portion by an angular crease line, and being flexible to permit axially-forward bending of the sections about the crease line as the container collapses under suction pressure by draining.

In this type of container, as the container collapses through draining of the liquid out of its neck under a gentle suction pressure which may be created by the simple suction pressure head of the drained liquid, the container collapses along the sides which are generally parallel to the major axis of the oval shoulder, while at the same time the sides of the container adjacent the ends of the major axis of the oval shoulder, where the gussets reside, spread outwardly.

It has been found that stress relief is provided by means of the "flat" or perpendicular sections of the shoulder portion adjacent the gusset portions, with the result that the flat sections end axially forward as the gussets pivot outwardly during collapse, providing stress relief to the entire action, which permits a further amount of collapse and spontaneous emptying of the container at a given suction pressure, when compared with previous designs of this collapsible container. Accordingly, the containers of this invention can contain less air volume in view of the reduced residual space, or, alternatively, less solution remains behind in the collapsed container.

Further in accordance with this invention, the container may be sealed at its end opposite to the neck portion with a seal line which defines a convex, arcuate seal line. This has been found to strengthen the overall seal at the tail end of the thin-walled container of this invention, particularly when the curved seal line is fabricated in accordance with the teachings of U.S. Pat. Nos. 4,010,783 and 4,076,063 with respect to the seal line disclosed therein.

The body portion of the container of this application, in its normal, unstressed configuration, preferably tapers inwardly from the shoulder portion at one end to the opposite end thereof, with the circumferences of transverse sections of the body portion decreasing from the one end to the opposite end, unlike what is disclosed in the previously cited patents. This type of container can be designed to collapse to not only a flat, but a planar configuration without bulging of the flattened container walls out of the general container plane, as in the previous embodiment, which, in turn, facilitates stamping or printing of labels on the containers of this invention. The above is due to the continuous taper from the shoulder to tail end of the container of this application, avoiding the transition corners found in a central portion of previous embodiments.

Referring to the drawings.

Figure 1:
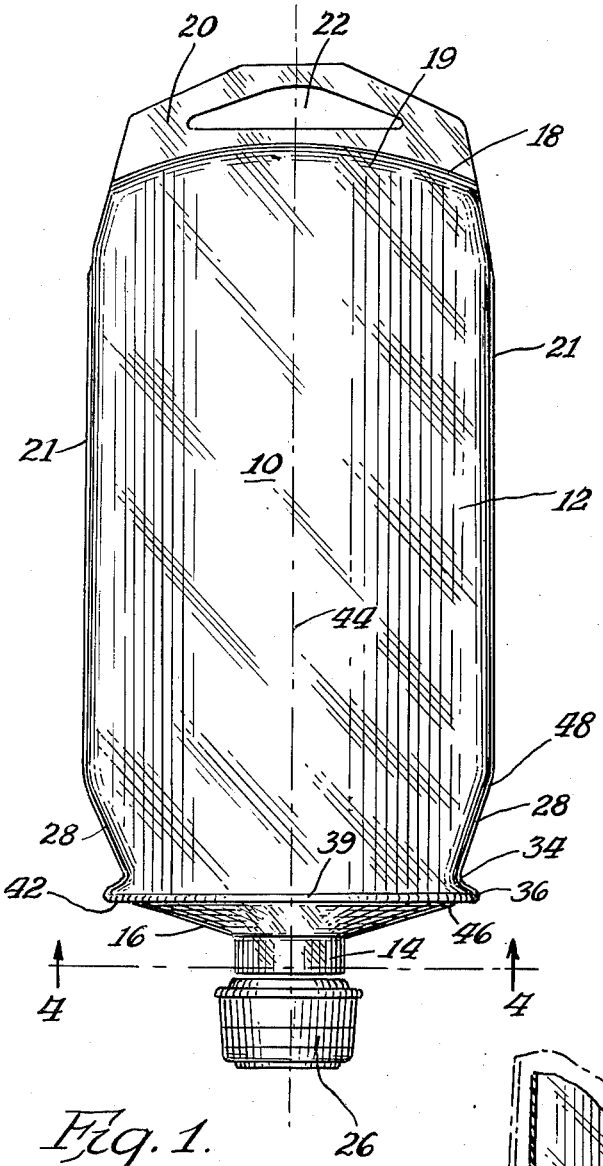
FIG. 1 is an elevational view of the container of this invention in its original, unstressed, as-molded configuration.

Referring to FIGS. 1 through 4, a molded, collapsible solution container 10 is disclosed which defines a body portion 12 having an integral neck portion 14 and shoulder portion 16 at one end thereof. Neck and shoulder portions 14, 16 are preferably relatively stiff, while the remainder of the container is flexible and collapsible.

Container 10 is sealed at its end 18 opposite the neck and shoulder portions 14, 16, and includes a flattened portion 20 defining a hanger hole 22 so that the container may be hung up for convenient administration of parenteral solution or any other material as desired.

End 18 of the container is defined by sealed area 19, which may be of convex, arcuate shape as shown specifically in FIG. 1, and may be otherwise made in accordance with the teachings of U.S. Pat. Nos. 4,076,063 and 4,010,783, which show a desired strengthening configuration for the tail seal which is especially effective for strengthening seals made of thin walls and even biaxially oriented material.

Accordingly, a tail seal for the collapsible container of this invention is provided which can resist the shock of dropping from higher levels, when compared with the previous embodiments. Specifically, seal line 19 occupies a recess 24 defined in the sealed end by the flexible container walls, with the sealed line and recess extending essentially the entire width of the container. The recess serves to absorb outwardly directed shock by movement of its walls to protect the seal line from rupture.

Also, as described in the patents cited above, a pair of spaced rod members may be formed as an integral part of the seal line and the flat plastic piece 20 formed integrally with and extending outwardly from it, the rod members extending transversely to the longitudinal axis of the container across its entire width, with the flat plastic piece 20 also defining a portion thereof between the rod members which is thinner than the remainder of the plastic piece spaced from the rod members to provide an integral and improved tail seal.

Neck portion 14 of the container is proportioned to receive a cap 26, which may be of a conventional design. Particularly, cap 26 may be of the design as described in U.S. Pat. application Ser. No. 886,081 filed Mar. 13, 1978 now U.S. Pat. No. 4,171,236. The container may also carry a conventional inner cap within cap 26 for sterile sealing of the container, being adapted to receive the spike of a parenteral solution set or the like with the spike passing through sleeves in the inner cap, to puncture a sealing diaphragm for access to the container.

Figure 2:
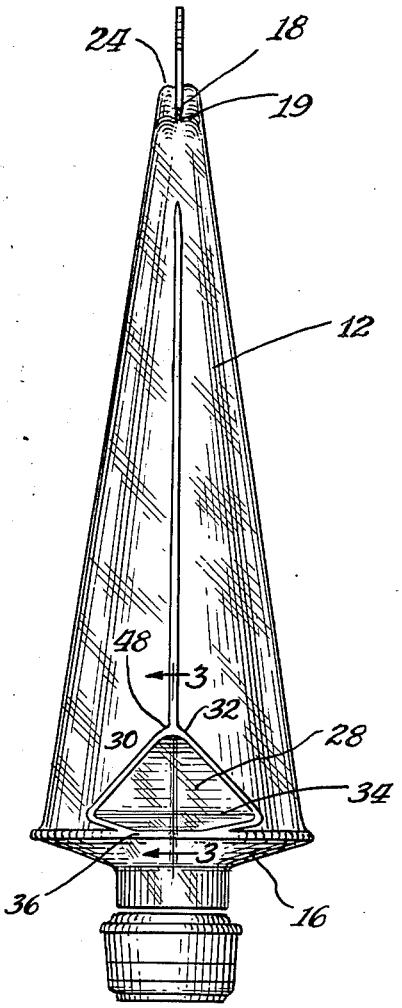
FIG. 2 is an elevational view of the container of FIG. 1, rotated about its longitudinal axis by 90°.
Figure 3:
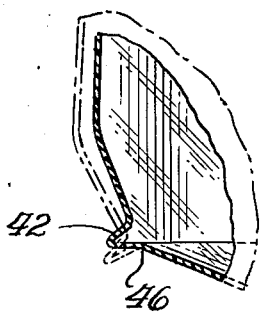
FIG. 3 is a fragmentary longitudinal sectional view of part of the shoulder portion of the container of FIG. 1, adjacent a gusset portion, taken along line 3—3 of FIG. 2.

As particularly shown in FIG. 2, the body portion 12 of the container is integral with shoulder 16 about the periphery thereof, and tapers on one dimension down to a narrow section at end 18, where the seal line 19 is found. However, typically, the other transverse dimension of body portion 12 of the container, along the line of the major axis of generally oval shoulder 16, is generally of equal length, as shown in FIG. 1, i.e., edges 21 may be parallel, although they may diverge or converge to some degree if desired.

Gusset portions 28 may be of the general type and configuration as described in U.S. application Ser. No. 744,230, filed Nov. 23, 1976, for example, proportioned appropriately as desired for the size of the specific container desired. Each gusset portion 28 defines lines of folding weakness 30, 32 as well as recessed line 34, plus the projecting shoulder tips 36 as in the previous embodiments.

Shoulder portion 16 extends outwardly, as the drawings show, from neck portion 14, and also extends to a slight degree axially rearwardly away from the neck portion, so that the periphery 38 of the shoulder portion 16 is displaced axially rearwardly away from the neck portion, when compared with central portions of the shoulder 16.

Portions 39 of the periphery of shoulder 16 which are generally in longitudinal relation with the major axis 40 of the shoulder portion define another bead line of flexing weakness, similar to that shown in the patents and applications cited above.

In accordance with this invention, sections 42 of the shoulder portion 16 which are adjacent gusset portions 28 and the ends of the major axis 40 do not extend axially rearwardly as the remainder of the shoulder portion, but instead normally extend, in their unstressed, as-molded configuration, in a plane which is perpendicular to the longitudinal axis 44 of the container, being connected to the remainder of the shoulder portion by an angular crease line 46 defined in the plastic of the shoulder. Sections 42 extend from crease line 46 and the remainder of shoulder portion at an angle of preferably about 130°–160°. The angular crease line is molded into the container and it, in conjunction with "flat" or perpendicular sections 42, provides an improvement in the action of the areas of the container around the gussets 28 as the container collapses.

Draining of the filled container typically takes place by opening cap 26 to expose the inner cap. A generally sterile connection is made in the case when a container is used for dispensing parenteral solutions, so that an administration set is in fluid connection with the interior of the container through neck portion 14. The container is then hung in inverted configuration by hanger 20 on an IV pole, and the parenteral solution is administered to the patient.

As the solution is administered, the suction pressure head of the parenteral solution in the administration set causes the container to begin to collapse, first at the tail end 18, with the walls of body portion 12 coming together into a flat configuration.

When the walls of the body portion 12 have come together throughout about the upper two thirds of the body portion 12, the collapse of the shoulder end of the container begins by the outward pivoting of the gussets, and the corresponding rising of the neck portion 14 and shoulder portion 16, as the gussets pivot outwardly, and the container walls of body portion 12 collapse inwardly.

Figure 5:
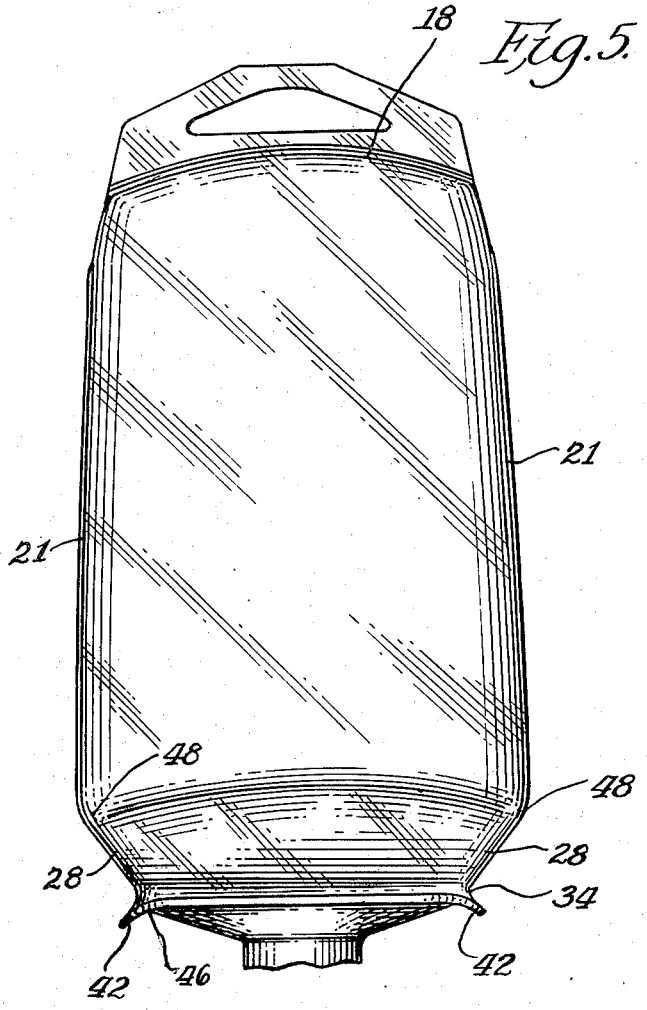
FIG. 5 is an elevational view of the container of FIG. 1, after it has been collapsed by the application of a gentle suction pressure such as a suction pressure head of about three feet of water.
Figure 6:
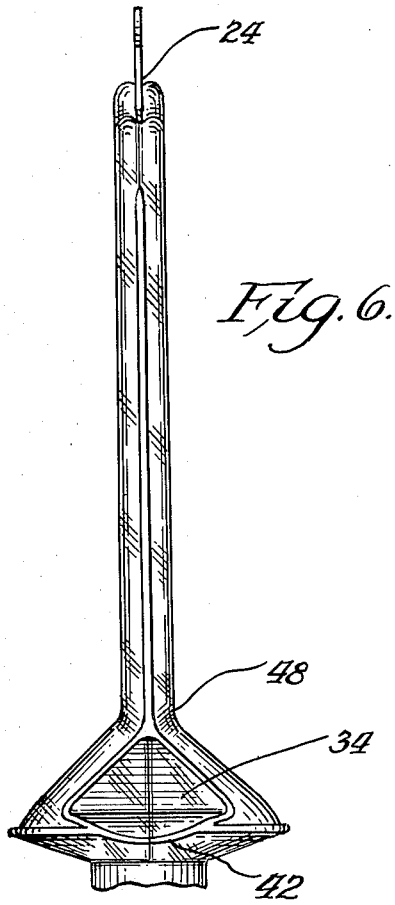
FIG. 6 is a plan view of the container of FIG. 5 as shown in its collapsed configuration, but rotated by 90° about its longitudinal axis.
Figure 4:
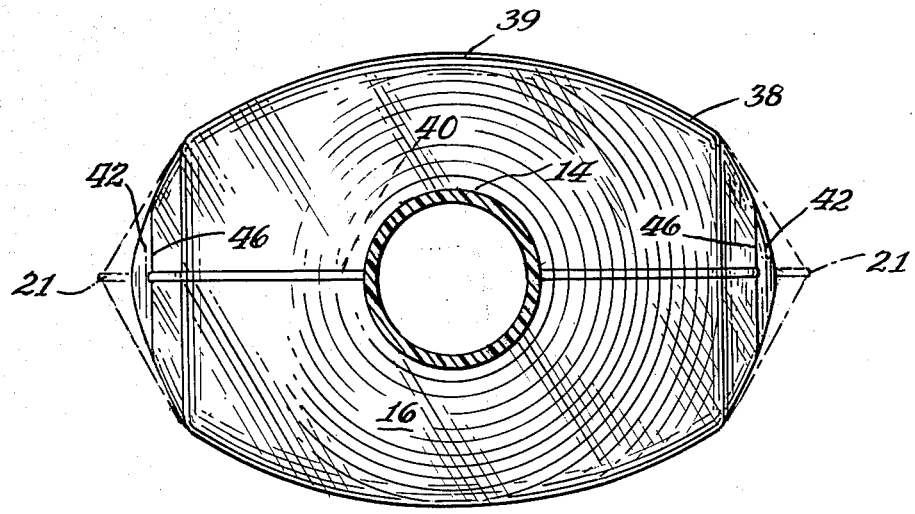
FIG. 4 is a sectional view of the neck and shoulder portion of the container of FIG. 1, taken along line 4—4.

A substantially collapsed configuration of the collapsed container is shown in FIGS. 5 and 6. A further amount of collapse than that shown can usually be expected to take place, with further outward pivoting of gussets 28. It can be seen that the walls of body portion 12 have generally collapsed in flat configuration with edges 21 entering into diverging relationship, and that the gussets 28 have pivoted outwardly so that connection areas 48 of various bead lines have moved outwardly, with each gusset portion generally pivoting about its line 34 and protruding shoulder portion 36.

Simultaneously with this, each of sections 42 bend generally about obtuse angular crease line 46, in an axially forward direction. This provides stress relief to interior line 34 of each gusset 28, permitting the further outward pivoting motion of the areas around gussets 28, to result in the opportunity for furthur collapse of the container, with a consequent added reduction of its internal volume in the collapsed configuration.

The container of this invention may be made by conventional blow molding techniques including conventional, commercial equipment and preferably using the methods described in U.S. Pat. No. 4,076,063.

Preferably, the wall thickness of the collapsible portions of the container may be about 0.015 inch, while the shoulder portion may also have a thickness of about 0.015 inch and the neck portion may be substantially thicker. The outer diameter of neck 14 may be about 43 mm..

The above has been offered for illustrative purposes only and is not intended to limit the invention of this application, which is as defined in the claims below.

That which is claimed is:

1. In a molded, collapsible solution container, which container defines a body portion having an integral neck portion and a relatively stiff shoulder portion at one end thereof, said container being sealed at its end opposite said one end, said shoulder portion including a peripheral portion circumscribing said body portion, a pair of gusset portions defined in said body portion adjacent said peripheral portion at circumferentially opposite sides of said peripheral portion, said shoulder portion extending outwardly from said neck portion and also extending axially rearwardly away from said neck portion, the improvement comprising:

outer sections of said peripheral portion adjacent the gusset portions normally extending in a plane perpendicular to the longitudinal axis of said container, each said outer section being connected to the remainder of said shoulder portion by a crease line to define an obtuse angle with the remainder of said shoulder portion, and being flexible to permit axially forward bending toward said neck of said sections about said crease line as said container collapses by draining.

2. The container of claim 1 which defines a convex, arcuate seal line at its end opposite to said one end.

3. The container of claim 1 in which said body portion, in its normal, unstressed configuration, tapers inwardly from the shoulder portion at one end to the opposite end, the circumferences of transverse sections of said body portion decreasing from said one end to the opposite end.

4. The container of claim 3 in which the seal of said container at said opposite end defines a convex arcuate seal line across the width of said body portion.

5. The container of claim 4 in which the wall thickness of said body portion is generally uniform at positions spaced from the ends thereof.

* * * * *